US006143702A

United States Patent [19]

Nadasdi

[11] Patent Number: 6,143,702

[45] Date of Patent: Nov. 7, 2000

[54] LUBRICATING OILS OF ENHANCED OXIDATION STABILITY CONTAINING N-PHENYL-NAPHTHYL AMINES, OR SUBSTITUTED DERIVATIVES OF N-PHENYL NAPHTHYL AMINE AND CARBODIIMIDE ACID SCAVENGERS

[75] Inventor: Todd Timothy Nadasdi, Kingsville, Canada

[73] Assignee: Exxon Research and Engineering Company, Florham Park, N.J.

[21] Appl. No.: 09/169,651

[22] Filed: Oct. 9, 1998

[51] Int. Cl.[7] ..... C10M 133/02

[52] U.S. Cl. ..... 508/550; 508/563

[58] Field of Search ..... 508/550, 563

[56] References Cited

U.S. PATENT DOCUMENTS

| | | | |
|---|---|---|---|
| 3,193,522 | 7/1965 | Neumann et al. | 508/550 |
| 3,210,281 | 10/1965 | Peeler | 508/563 |
| 3,346,496 | 10/1967 | Neumann et al. | 508/550 |
| 4,770,802 | 9/1988 | Ishida et al. | 508/563 |
| 5,186,852 | 2/1993 | Ishida et al. | 508/563 |
| 5,498,356 | 3/1996 | Kamakura et al. | 508/550 |
| 5,614,483 | 3/1997 | Fessenbecker et al. | 508/550 |
| 5,806,336 | 9/1998 | Sunaga et al. | 62/469 |

FOREIGN PATENT DOCUMENTS

| | | |
|---|---|---|
| 0715079 | 6/1996 | European Pat. Off. . |
| 9-188891 | 7/1997 | Japan . |

OTHER PUBLICATIONS

"A New Additive for the Hydrolytic and Oxidative Stabilization of Ester based Lubricants and Greases", Roehrs & Fessenbecker, NLGI Spokesman, vol. 61, No. 3, pp. 10–16, Jun. 1997.

*Primary Examiner*—Jerry D. Johnson
*Attorney, Agent, or Firm*—Joseph J. Allocca

[57] ABSTRACT

Lubricating oils of enhanced oxidation stability are obtained by adding to the lubricating oil a mixture comprising n-phenyl-1-naphthyl amine and an acid scavenger such as carbodiimide.

11 Claims, No Drawings

LUBRICATING OILS OF ENHANCED OXIDATION STABILITY CONTAINING N-PHENYL-NAPHTHYL AMINES, OR SUBSTITUTED DERIVATIVES OF N-PHENYL NAPHTHYL AMINE AND CARBODIIMIDE ACID SCAVENGERS

BACKGROUND OF THE INVENTION

1. Field of the Invention

The present invention relates to lubricating oils and to a method for improving the oxidative stability of such oils by using a combination of additives.

2. Description of the Related Art

The literature contains numerous examples of combinations of compounds to give improved oxidation stability to lubricating oils.

Amine antioxidants have been found to act in concert with phenolic antioxidants to give improved oxidation stability. This form of cooperative interaction is termed homosynergism because both compounds act by the same stabilization mechanism, in this case a free radical decomposing mechanism. See Mescina and Karpukhina, Zik. Maizus. Neflekhimiya 12, 731 (1972).

Compounds which act by different stabilizing mechanisms can give rise to heterosynergism. For example, alkylated diphenylamine, a radical scavenger in combination with organosulfur compounds, a hydroperoxide decomposer, have been shown to lead to increased oxidation stability in the ASTM D943 oxidation test, see Rosberger, M. Chemistry and Technology of Lubricants, page 108, VHC Publishers Inc., New York, 1992. The ASTM D943 test measures the time required for a test oil to attain a Total Acid Number (TAN) of 2.0 mg KOH/g. Another typical oxidation test used as an industry standard is the Rotary Bomb Oxidation Test (ASTM D 2272) in which oxidation life is measured in minutes prior to an oxygen pressure drop of 25 pounds.

U.S. Pat. No. 3,346,496 is directed to lubricating oils containing carbodiimides as antioxidants. The patent states that the use of carboidiimides makes it possible to substantially improve the resistance of various types of lubricants to oxidative attack. The lubricants can be based on mineral oils or synthetic oil base stocks such as polyethers or polyether esters. The carbodiimides are also reported as being effective protective agents against corrosion and as being capable of keeping decomposition products formed during the lubricating process in solution. The patent states that the carbodiimides can be added to the lubricants in combination with diphenyl amine anti oxidants or hydroquinolines and that, surprisingly, a synergistic effect is achieved. Review of the data presented in U.S. Pat. No. 3,346,496 and the different pathways by which carbodiimides and diphenyl amines act, however, show that these statements are not correct.

The carbodiimides react with acidic molecules (carboxylic acids, inorganic acids . . .) to give neutral products. Thus, if an oil has acidic components, adding a carbodiimide will lower the Total Acid Number (TAN) of the oil. The oxidation of mineral oils is widely understood to take place through a free radical mechanism. Some of the reaction products of this oxidation process are organic acids such as carboxylic acids. The presence of these acids, however, does not significantly promote the oxidation of the mineral oil. Another way of saying this is that the free radical oxidation of mineral oils is not acid catalyzed. Molecules that acts as antioxidants for mineral oils do so by either interrupting the free radical propagation mechanism of the oxidation process or by decomposing free radical initiators such as hydroperoxides. By doing this, they slow down the oxidative degradation of the oils.

The TAN of an oil is often used as an indication of the extent to which the oil has oxidized. Again, this is because the concentration of acidic molecules in an oil increases as the oil oxidizes and is thus an indirect measure of the extent of oxidation of the oil. The examples shown in U.S. Pat. No. 3,346,496 use the D 943 oxidation test to measure the oxidation life of the oils. This test measures the TAN of the oil. The time it takes for the TAN of the oil to reach 2.0 mg KOH/mg is deemed the oxidation life of the oil for this test. A unique situation is created when an acid scavenging molecule, such as a carbodiimide, is added to an oil. The TAN can no longer be used as a measure of the oxidation life of the oil. The oil will undergo its normal oxidation process but the acidic byproducts of oxidation are effectively removed from the oil and therefore the concentration of acid in the sample does not accurately reflect the extent of oil oxidation.

It is expected that, in a mineral oil which contains both a diphenyl-amine antioxidant and a carbodiimide acid scavenger, the oxidation life of the oil, as measure by the D 943 test, would be approximately equal to the sum of the oxidation life of the same oil with the same concentration of diphenylamine and the same mineral oil with the same concentration of carbodiimide minus the oxidation life of the mineral oil itself (so you do not count it twice). This is because the diphenylamine antioxidant would react to interfere with the oxidation process of the oil until the diphenylamine was depleted. At this point the oil would start to oxidize and produce acidic products. Once formed, these acidic products would react with the carbodiimide. The TAN of the oil would remain low until the carbodiimide was depleted. These two processes are separate events which, for the most part, would happen sequentially.

Table 1 of U.S. Pat. No. 3,346,496 lists TAN data, from D 943 testing, relevant to their invention. Review of the data of U.S. Pat. No. 3,346,496 reveals that the TAN of a naphthene-based oil, with 1% of 2,6,2',6'-tetra-isopropyl-diphenyl-carbodiimide, reaches 2.0 mg KOH/mg after about 510 hours on test. The TAN of the same naphthene-based oil, with 0.2% 4,4'-dimethylbenzyldiphenylamine, would reach 2.0 mg KOH/mg after about 350 hours on test. From Table 1 of U.S. Pat. No. 3,346,496 it can be estimated that the naphthene-bases oil per se reached a TAN=2.0 mg KOH/mg after about 30 hours. Therefore, a formulation in the same naphthene-based oil containing 1% of 2,6,2',6'-tetra-isopropyl-diphenyl-carbodiimide and 0.2% 4,4'-dimethylbenzyldiphenylamine would be expected to reach a TAN of 2.0 mg KOH/mg after about 830 hours on test. The data shows this exact combination to reach a TAN of 2.0 mg KOH/mg after about 915 hours on test. This gives a difference of about 85 hours between the expected lifetime and the measured lifetime. The precision statement for the D 943 test states that the repeatability of the test method is 0.192× (mean measurement value). Therefore, the measured value of 915 hours has an error of +/−176 hours. Consequently, the measured value of 915 hours is not statistically different from the expected value of about 830 hours. A synergy has only occurred when the combined effect of two or more agents is greater than the sum of the effects of each of the agents separately. Contrary to the claim, the data presented in the U.S. Pat. No. 3,346,496 shows that the combination of carbodiiminde and diphenylamine are not synergistic.

DESCRIPTION OF THE PRESENT INVENTION

It has been discovered that a mixture of carbodiimide acid scavenger and N-phenyl-naphthylamine or substituted derivatives of N-phenyl naphthyl amine acts synergistically to extend the oxidation life of mineral oils especially those mineral oils of high saturates content such as catalytically hydrogenated oils including hydrocracked, hydrotreated, hydrofined, hydroisomerized oils and white oils and synthetic oils such as PAO, gas conversion oils, ethers, and esters, polyalkylene glycol (PAG), and phosphate esters.

The mono or poly acid scavenger used in the present invention is one or more mono or poly carbodiimide. Useful mono carbodiimides include materials of the formula $$R_1—(N{=}C{=}N)—R_2$$

wherein $R_1$ and $R_2$ are the same or different and are hydrogen, hydrocarbyl groups or nitrogen and/or oxygen containing hydrocarbyl groups. Thus $R_1$ and $R_2$ can be $C_1$–$C_{12}$ aliphatic groups, $C_6$–$C_{18}$ aromatic groups or aromatic-aliphatic groups.

Thus, $R_1$ and $R_2$ may be for example hydrogen atom, alkyl groups such as methyl, ethyl, propyl, isopropyl, butyl, isobutyl, pentyl, 2-methylbutyl, hexyl, heptyl, octyl, 2-ethylhexyl, nonyl, decyl, undecyl dodecyl and the like, alkenyl groups such as propenyl, butenyl, isobutenyl, pentenyl 2-ethylhexenyl, octenyl and the like, cycloalkyl groups such as cyclopentyl, cyclohexyl, methylcyclopentyl, ethylcyclopentyl and the like, aryl groups such as phenyl, naphthyl and the like, alkyl substituted aryl groups such as alkyl substituted phenyl groups for example toluyl, isopropylphenyl, diisopropylphenyl, triisopropylphenyl, nonylphennyl and the like, aralkyl groups such as benzyl, phenetyl and the like. Examples of monocarbodiimides are the following: di-isopropyl-carbodiimide, di-n-butyl-carbodiimide, methyl-tert-butyl-carbodiimide, dicyclohexyl-carbodiimide, diphenyl-carbodiimide, di-p-tolyl-carbodiimide and 4,4'-didodecyl-diphenyl-carbodiimide. Of special advantage are diphenyl-monocarbodiimides which carry on the phenyl moiety at the ortho-position to the carbodiimide group various substituent groups, e.g., alkyl, alkoxy, aryl and aralkyl radicals, such as 2,2'-diethyl-di-phenyl-carbodiimide, 2,2'-di-isopropyl-diphenyl-carbodiimide, 2,2'-diethoxy-diphenyl-carbodiimide, 2,6,2'6'-tetra-ethyl-diphenyl-carbodiimide, 2,6,2',6'-tetraisopropyl-di-phenyl-carbodiimide, 2,6,2',6'-tetraethyl-3,3'-dichloro-di-phenyl-carbodiimide, 2,2'-diethyl-6,6'-dichloro-diphenyl-carbodiimide, 2,6,2',6'-tetra-isobutyl-3,3'-dinitro-diphenyl-carbodiimide and 2,4,6,2'4',6'-hexaisopropyl-diphenyl-carbodiimide.

Suitable polycarbodiimides are, for example, tetramethylene-ω,ω'-bis-(tert-butyl-carbodiimide), hexamethylene-ω,ω'-bis-(tert-butyl-carbodiimide), tetramethylene-ω,ω'-bis-(phenyl-carbodiimide) and those compounds which may be obtained by heating aromatic polyisocyanates such as 1,3-di-isopropyl-phenylene-2,4-di-iso-cyanate, 1-methyl-3,5-diethyl-phenylene-2,4-diisocyanate and 3,5,3',5'-tetra-isopropyl-diphenylmethane-4,4-di-isocyanate, in the presence of tertiary amines, basically reacting metal compounds, carboxylic acid metal salts or non-basic organometal compounds at a temperature of at least 120° C., according to the process of German Pat. No. 1,156,401.

Amine anti-oxidant used in the present invention is N-phenyl-naphthyl amine or substituted derivatives of N-phenyl naphthyl amine, preferably N-phenyl-1-naphthyl amine or substituted derivatives of N-phenyl-1-naphthyl amine generally of the formula:

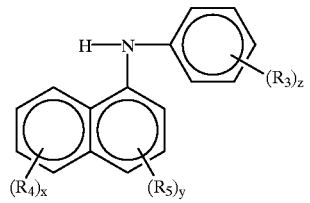

wherein $R_3$, $R_4$ and $R_5$ are the same or different and are hydrogen, $C_1$–$C_{12}$ hydrocarbyl group, or $C_1$–$C_{12}$ hydrocarbyl group containing O, N or S hetero-atom or hetero atom moiety containing group selected from the group consisting of carboxyl, hydroxy, carbonyl, ether, ester, thioether, amine where the hetero-atom moiety containing group is substituted onto the $C_1$–$C_{12}$ hydrocarbyl backbone or the hetero atom constitutes part of the hydrocarbyl backbone and x, y and z are the same or different and are 1 to up to the unsatisfied valence of the respective phenyl and naphthyl moiety, preferably 1 to 3, and wherein when x, y or z are each 2 or greater, each $R_3$, $R_4$ or $R_5$ are the same or different and are as stated above. It is preferred that $R_3$ is H or $C_1$–$C_{12}$ hydrocarbyl most preferably $C_8$, and $R_4$ and $R_5$ are H, and x, y and z are each 1.

It has been found that combination of other acid scavengers with N-phenyl-naphthylamine of the type described above and similarly combinations of different diaryl amines antioxidant with carbodiimide acid scavengers do not result in the synergistic improvement in resistance to oxidation as is evidenced by the combination of carbodiimide and N-phenyl-naphthylamine and substituted derivatives of N-phenyl naphthyl amines of the type described above.

The base lubricating oils which may be advantageously treated using the combination is any natural or synthetic oil of lubricating viscosity, preferably a lubricating oil characterized as a high saturates base stock, i.e., base stock of at least about 92% saturates, preferably about 95% saturates, more preferably about 97% saturate most preferably about 99% saturates.

Typical natural oils include paraffinic and naphthenic mineral oils and especially hydrotreated oils.

Synthetic oils include polyalpha olefins and ester oils, especially polyol ester oils made by reacting polyhydric alcohols such as those containing 2–6 hydroxyl group with acids such as mono or di carboxylic acids containing for example 2–40 carbon atoms, preferably mono- or di-carboxylic acids containing 16–36 carbon atoms such as oleic, linoleic or linolenic acid and dioleic acid. Typical polyhydric alcohols include trimethylol propane, penta erythritol and tech penta-erythritol. Suitable polyol esters are described generally in the literature, see, e.g., U.S. Pat. Nos. 5,658,863, 5,681,800, 5,767,047, 4,826,633.

In the practice of the present invention the lubricating oil base stock contains from about 0.05 to 5 wt % of the carbodiimide, preferably about 0.10 to 1.0 wt % and from about 0.05 to 5 wt % N-phenyl-naphthyl amine, or substituted derivative of N-phenyl naphthyl amine preferably about 0.1 to 1.0 wt %.

The lubricating oils for the present invention may also contain any of the other commonly used lubricating oil additives. Thus, the formulated oils can contain additional anti oxidants such as phenol and other amine type anti oxidants, viscosity and viscosity index improvers such as polyalkylene or polyolefin viscosity improver, e.g., polyisobutylene, poly(meth)acrylate viscosity index improvers metal deactivator such as triazoles and thiadiazoles, extreme pressure and anti wear additives such as phosphate esters, amine phosphates sulfurized olefins, other sulfurized and polysulfurized hydrocarbons, metal thio phosphates such as ZDDP, metal thio carbamates, anti rust agents such as carboxylic acids, dispersants such as succinimides, detergents such as metal sulfonates, phenates or carboxylates, anti foamants, etc. The amount of such other additives included in the formulation will be the amount typically and traditionally used in formulated oils, resulting in an amount in total in the range 0 to 20 wt %.

The invention is further described by reference of the following comparative examples and non-limiting examples.

EXAMPLES

Example 1

In the following runs the data was collected using the Rotary Bomb Oxidation Test which is a direct measure of the oxidation life of an oil. It measures the time required for an oil to react with a set amount of oxygen (25 psi at 150° C.).

A 150N hydrotreated base oil with about 99% saturates was formulated with two copper deactivators to produce a base fluid. To this base fluid was added various acid scavengers and amine type antioxidants, individually and in various combinations.

Table 1 shows the different formulations tested and the RBOT results.

TABLE 1

| | | RUN | | | | | | | | | |
|---|---|---|---|---|---|---|---|---|---|---|---|
| COMPONENT** | PURPOSE | Comp. 1 | Comp. 2 | Comp. 3 | Inv. 1* | Comp. 4 | Comp. 5 | Comp. 6 | Comp. 7 | Comp. 8 | Inv. 2* |
| Hydrotreated BS | Basestock | 99.91 | 99.41 | 99.61 | 99.11 | 99.11 | 99.61 | 99.11 | 99.61 | 99.11 | 99.11 |
| Triazole | Cu deactivator | 0.08 | 0.08 | 0.08 | 0.08 | 0.08 | 0.08 | 0.08 | 0.08 | 0.08 | 0.08 |
| Thiadiazole | Cu deactivator | 0.01 | 0.01 | 0.01 | 0.01 | 0.01 | 0.01 | 0.01 | 0.01 | 0.01 | 0.01 |
| Alkyl $C_8$ phenyl naphthyl amine | Amine antioxidant | | | 0.30 | 0.30 | 0.30 | | | | | 0.30 |
| Secondary alkyl diaryl P,P'-diamine | Amine antioxidant | | | | | | 0.30 | 0.30 | | | |
| Diphenyl amine | Amine antioxidant | | | | | | | | 0.30 | 0.30 | |
| Additin RC 8500 | Acid scavenger | | 0.50 | | 0.50 | | | 0.50 | | 0.50 | 0.50 |
| Dicyclohexylamine | Acid scavenger | | | | | 0.50 | | | | | |
| RBOT (min) | | 43 | 63 | 1865 | 2600 | 1516 | 700 | 598 | 437 | 462 | 2954 |
| Change vs. Base | | base | 20 | 1822 | 2557 | 1473 | 657 | 555 | 394 | 419 | 2911 |
| Difference, in minutes, above or below that expected from a simple addition of individual effects | | — | — | — | +715 | −349 | — | −122 | — | 5 | 1069 |

*Reporting 2 separate test runs, each using fresh portions of the same formulation sample.
**Quantities are in wt %.

Additin RC 8500 is R—N═C═N—R, wherein R is 2,6'diisopropylphenyl

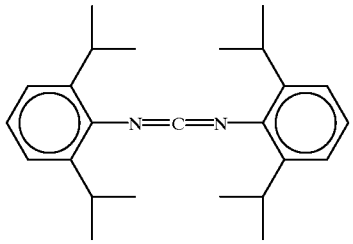

Referring to Table 1, comparative run 1 (Comp. 1) shows the combination of hydrotreated basestock plus copper deactivator provides a RBOT life of 43 minutes. The addition of carbodiimide gives a marginal improvement of 20 minutes to 63 minutes total as shown in comparative run 2 (Comp. 2). Comparative run 3 (Comp. 3) demonstrates that the addition of a phenyl-naphthylamine antioxidant to hydrotreated basestock gives a marked improvement to 1865 minutes. In the presence of the carbodiimide invention run 1 (Inv. 1) however, there is an additional significant increase in antioxidant level to 2600 minutes, an increase of nearly 40% over the addition of phenylnaphthyl-amine and substantially more than the 20 minute improvement shown in column 2, clearly evidencing synergy of the carbodiimide and N-phenyl-1 -naphthyl-amine.

The choice of acid scavenger is important to the current invention as shown in comparative run 4 (Comp. 4). Addition of an alternative acid scavenger, dicyclohexylamine actually retards the effect of the phenylnaphthyl-amine antioxidant from an 1865 minute RBOT life down to 1516 minutes (Comp. 3 vs. Comp. 4). The choice of amine antioxidant is also important as shown by comparing Comp. 5 and Comp. 6 and Inv. 1 and Inv. 2 or Comp. 7 and Comp. 8 to Comp. 3 and Inv. 1 and Inv. 2.

Phenyl naphthyl amine and related substituted phenyl naphthyl amines are common antioxidants in lubricating oils. Additin RC 8500 is typically used as a hydrolytic stabilizer for ester fluids.

Example 2

A series of runs was conducted utilizing a 92% saturates hydrotreated base stock as base oil, in combination with two copper deactivators to produce a base fluid which was then additized with an acid scavenger, an anti oxidant and a combination of the acid scavenger and anti oxidant. Table 2 shows the different formulations tested and the RBOT result.

As is seen, the combination of the acid scavenger and amine anti oxidant of choice, when employed in a 92% saturates base stock did not produce as dramatic an improvement in RBOT life (Run 4) as was obtained when the combination was employed in a 99% saturates base stock (Inv. 1 and Inv. 2 from Table 1). While directionally it is seen that there is some improvement in performance, it may not be statistically significant considering the degree of repeatability of the RBOT test for lifetimes in the 1500–2000 minute range, which is about 100–200 minutes. However, this is still indicative that the additives do not interfere with each other and, directionally shows the benefit of the use of the combination and the desirability of the use of the combinations in high saturates base stock formulation, that is, formulations using base stock of greater than 92% saturates.

TABLE 2

| Component* | Purpose | Run 1 | Run 2 | Run 3 | Run 4 |
|---|---|---|---|---|---|
| Hydrotreated BS (~92 wt % sats) | Basestock | 99.91 | 99.41 | 99.61 | 99.11 |
| Triazole | Cu deactivator | 0.08 | 0.08 | 0.08 | 0.08 |
| Thiadiazole | Cu deactivator | 0.01 | 0.01 | 0.01 | 0.01 |
| Alkyl $C_8$ phenyl naphthylamine | Amine antioxidant | | | 0.30 | 0.30 |
| Additin RC 8500 | Acid scavenger | | 0.50 | | 0.50 |
| RBOT (min) | | 58 | 77 | 1585 | 1805 |
| Change vs. Base | | base | 19 | 1527 | 1747 |
| Difference (min) above or below that expected from a sample addition of individual additives | | — | — | — | 201 |

*Quantities are in wt %

In summary, the current invention relates to the combination of N-phenyl-napthylamines or substituted derivatives of N-phenyl naphthyl amines and carbodiimides to provide improved oxidation stability in lubricating oils.

Thus it is seen that while acid scavengers are useful to slow down the degradation of fluids such as ester based fluids where acids act to catalyze the breakdown of the fluid by hydrolysis coupled with oxidation, they do not have a significant antioxidant effect per se on base fluids themselves. However, a specific type of acid scavenger combined with a specific type of antioxidant shows an enhanced ability to increase the oxidative resistance per se of base oils. It is not at all apparent just which particular combination would demonstrate an enhancement of oxidation resistance beyond the mere addition of each contribution of the individual ingredients. It is not enough simply to combine any acid scavenger with any aminic anti oxidant and add that mixture to a base oil, but rather a specific acid scavenger must be combined with a specific aminic anti oxidant if a synergistic enhancement of the oxidation resistance of the lubricant is to be achieved.

What is claimed is:

1. A lubricating oil composition of enhanced oxidation stability comprising a major amount of a base oil of lubricating viscosity selected from the group consisting of natural mineral oils and synthetic oil and mixtures thereof wherein said natural mineral oils have a saturates content of at least about 92%, and said synthetic oils are selected from the group consisting of polyalpha olefins, gas conversion oils, and phosphate esters and a minor amount of additives comprising carbodiimide and N-phenyl-naphthyl amine or substituted derivative of N-phenyl naphthyl amine, wherein the N-phenyl naphthyl amine or substituted derivative of N-phenyl naphthylamine is of the general formula:

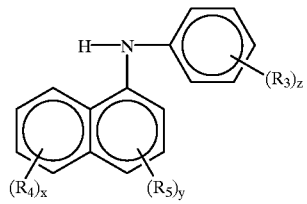

wherein $R_3$, $R_4$ and $R_5$ are the same or different and are hydrogen, $C_1$–$C_{12}$ hydrocarbyl group, or $C_1$–$C_{12}$ hydrocarbyl group containing O, N or S heteroatom or heteroatom moiety containing group selected from the group consisting of carboxyl, hydroxy, carbonyl, ether, ester, thioether, amine and mixtures thereof wherein the heteroatom moiety containing group is substituted onto the $C_1$–$C_{12}$ hydrocarbyl backbone, or the heteroatom constitutes part of the hydrocarbyl backbone and x, y and z are the same or different and are 1 to up to the unsatisfied valence of the respective phenyl and naphthyl moiety.

2. The lubricating oil of claim 1 wherein x, y and z are each 1 to 3.

3. The lubricating oil of claim 1 wherein x, y and z are each 2 or greater.

4. The lubricating oil of claim 1 wherein $R_3$ is H or $C_1$–$C_{12}$ hydrocarbyl, $R_4$ and $R_5$ are H and x, y and z are each 1.

5. The lubricating oil of claim 1, 2, 3 or 4 wherein the carbodiimide content is in the range of about 0.05 to 5 wt % and the amine content is in the range about 0.05 to 5 wt %.

6. The lubricating oil of claim 5 further containing from 0–20 wt % of other lubricating oil additives.

7. A method for enhancing the oxidation stability of a lubricating oil composition comprising adding to the lubricating oil composition an additive comprising carbodiimide and N-phenyl naphthyl amine or substituted derivative of N-phenyl naphthyl amine, wherein the N-phenyl naphthyl amine or substituted derivative of N-phenyl naphthyl amine is of the general formula:

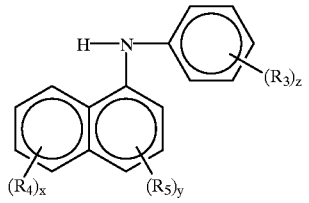

wherein $R_3$, $R_4$ and $R_5$ are the same or different and are hydrogen, $C_1$–$C_{12}$ hydrocarbyl group, or $C_1$–$C_{12}$ hydrocarbyl group containing O, N or S heteroatom or heteroatom moiety containing group selected from the group consisting of carboxyl, hydroxy, carbonyl, ether, ester, thioether, amine and mixtures thereof wherein the heteroatom moiety containing group is substituted onto the $C_1$–$C_{12}$ hydrocarbyl backbone, or the heteroatom constitutes part of the hydrocarbyl backbone and x, y and z are the same or different and are 1 to up to the unsatisfied valence of the respective phenyl and naphthyl moiety.

8. The method of claim 7 wherein the amount of carbodiimide added to the lubricating oil is in the range about 0.05 to 5 wt % and the amount of amine added to the lubricating oil is in the range about 0.05 to 5 wt %.

9. The method of claim 7 wherein x, y and z are each 1 to 3.

10. The method of claim 7 wherein x, y and z are each 2 or greater.

11. The method of claim 7 wherein $R_3$ is H or $C_1$–$C_{12}$ hydrocarbyl, $R_4$ and $R_5$ are H and x, y and z are each 1.

* * * * *